US005234258A

United States Patent [19]

Komotzki

[11] Patent Number: 5,234,258

[45] Date of Patent: Aug. 10, 1993

[54] CUTTER FOR EXTRACTION MACHINES

[75] Inventor: Michael Komotzki, Vohdeweg 46, D-4607 Kamen-Heeren-Werve, Fed. Rep. of Germany

[73] Assignee: Michael Komotzki, Dortmund, Fed. Rep. of Germany

[21] Appl. No.: 924,007

[22] PCT Filed: Jan. 16, 1992

[86] PCT No.: PCT/DE92/00048

§ 371 Date: Sep. 22, 1992

§ 102(e) Date: Sep. 22, 1992

[87] PCT Pub. No.: WO92/13175

PCT Pub. Date: Aug. 6, 1992

[30] Foreign Application Priority Data

Jan. 23, 1991 [DE] Fed. Rep. of Germany ..... 4101816
Feb. 12, 1991 [DE] Fed. Rep. of Germany ..... 4104277

[51] Int. Cl.[5] ..... E21C 35/18; E21C 35/22
[52] U.S. Cl. ..... 299/81; 175/424
[58] Field of Search ..... 299/17, 12, 81; 175/424

[56] References Cited

U.S. PATENT DOCUMENTS 4,705,321 11/1987 Hedlvnd ..... 299/81

FOREIGN PATENT DOCUMENTS 4015022 11/1990 Fed. Rep. of Germany .
3920205 12/1990 Fed. Rep. of Germany .
2141765 1/1985 United Kingdom .

*Primary Examiner*—David J. Bagnell
*Attorney, Agent, or Firm*—Peter K. Kontler

[57] ABSTRACT

A cutting implement for a mining machine includes a chisel and a holder for the chisel. The chisel has a flange which abuts the holder and is provided with a first recess. The holder has a second recess which registers with the first recess and communicates with a water supply channel in the holder. The second recess accommodates a hollow cylindrical seal. A tubular element bridges the two recesses and has a portion of smaller diameter which is received by the seal and a portion of larger diameter which is located in the first recess and confines the seal. The portion of larger diameter is embraced by a cap, and the cap carries a nozzle which is arranged to spray the cut made by the chisel. The seal, tubular element, cap and nozzle are all recessed from the outer peripheral surface of the chisel.

9 Claims, 2 Drawing Sheets

CUTTER FOR EXTRACTION MACHINES

Figure 1:
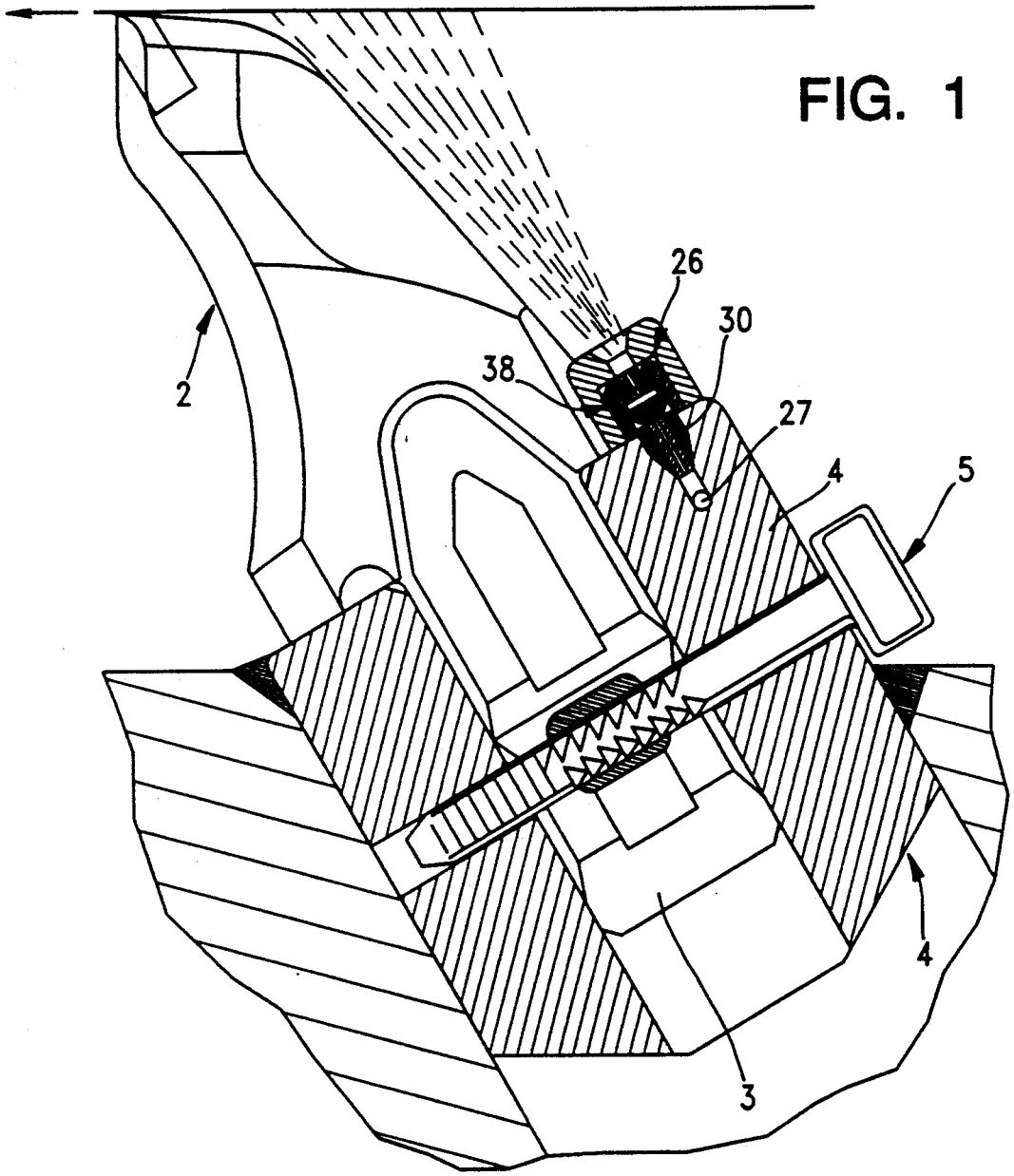

The invention relates to a cutter for extraction machines.

The German patent 39 20 205 describes an arrangement of a nozzle on a chisel holder in which the nozzle insert is stepped. A small annular sealing element is provided at the foot of the nozzle insert and the nozzle insert is pressed onto the sealing element by application of a holding device. This small sealing element has been found to be inadequate.

A chisel of the type to which the invention relates is disclosed, for example, in the German Offenlegungsschrift 40 15 022.

In this known chisel, a pressure seal is provided in the channel of the chisel holder and projects beyond the upper edge of the chisel holder. However, in the assembled condition of the chisel holder and the chisel head, the pressure seal projects into a matching bore in the support flange of the chisel head. The pressure seal acts as a gap bridging component and has a water guide channel which leads to the actual nozzle.

Thus, in this known arrangement, the small but unavoidable gap between the upper edge of the chisel holder and the lower side of the support flange of the chisel head is bridged by the pressure seal. To provide adequate sealing, the pressure seal must consist of a relatively elastic material and it has been found that this arrangement has certain drawbacks.

One drawback is that the pressure seal does not resist a high water pressure such as, for instance, of the order of 200 bars, but pushes into the gap where it bursts.

When the chisel is changed, the pressure seal projects significantly beyond the upper edge of the chisel holder, i.e., the sealing is exposed. The upper side of the sealing element can here be damaged by scratches or the like so that, upon reinsertion of a new chisel, the entire seal comes into question.

In the known arrangement, the nozzle opens at the upper side of the foot portion of the chisel head and here, during operation, this nozzle is constantly damaged. Thus, the nozzle must be frequently changed if, indeed, it is not so badly damaged that the chisel must be changed also.

Since the pressure seal must engage in a corresponding receiving bore of the chisel and, in assembled condition, must here also seal by means of pressure, difficult sealing surface machining of a bulk part such as constituted by the actual wear chisel is required. As a result, the known arrangement is costly.

That the actual nozzle in the known arrangement is installed via a thread is likewise disadvantageous since substantial costs are involved in production of the thread and the thread can be readily damaged.

It is an object of the invention to provide a cutter for extraction machines, i.e., a chisel with nozzle, in which the actual nozzle insert is arranged within the chisel holder or the chisel head such that, notwithstanding a change of the chisel, damage to the seal is no longer possible, and such that bursting of the pressure seal is prevented even at high pressures.

This object of the invention is achieved by the teaching of the main claim.

Advantageous embodiments are described in the subclaims.

In other words, it is proposed that a receiving bore be arranged in the actual chisel holder, i.e., a longer-lived component, and that the receiving bore accommodate a pressure seal which, however, does not project beyond the upper edge of the chisel holder when the chisel is inserted. A tubular portion of a gap bridging component made from a relatively rigid, i.e., relatively inelastic, plastic engages in the pressure seal which has an annular configuration. This plastic absorbs the pressures acting in the region of the gap without difficulty and, upon insertion in the pressure seal, presses the pressure seal tightly into the receiving chamber of the chisel holder. This gap bridging component then projects beyond the foot of the chisel head and this gap bridging component receives the actual nozzle. The nozzle is now located at a distance from the upper side of the foot portion of the chisel head. Consequently, damage during operation of the chisel is virtually eliminated.

If, according to the invention, the gap bridging component is made of two parts, it is possible, without difficulty, to insert a sieve which is matched to the respective characteristics and nozzle diameter between these two parts. The actual gap bridging component, whose head portion engages in the foot portion of the chisel, is received with play in a bore provided there. Easy removal of the chisel is thus possible, i.e., the gap bridging component, the nozzle and the pressure seal remain in the chisel holder upon removal of the chisel. Since damage, e.g., at the outer wall of the gap bridging component, has absolutely no effect on the seal, an unproblematic change of the chisel is now possible without consequences for the sealing of the nozzle insert.

An exemplary embodiment of the invention is described below with reference to the drawings. The drawings show in FIG. 1 the arrangement of the nozzle insert on a cutting chisel, and in FIG. 2 an exploded illustration of the actual nozzle insert.

In the drawing, 2 identifies a chisel head having a chisel stem 3 which engages in a corresponding receiving bore of a chisel holder 4. The chisel holder 4 is arranged on an extraction machine in a manner known per se. The chisel stem 3 is secured in the receiving opening of the chisel holder 4 by means of a key 5.

A channel 27 can be observed in the chisel holder 4 and serves to supply water for spraying the cut of the chisel or the chisel head. To this end, a nozzle insert 26, whose structure is clearer from FIG. 2, is provided in the chisel.

This nozzle insert consists, seen collectively, of a pressure seal 30 made of a soft, elastic material which is thus a good sealing material. As shown, once more, in FIG. 1, this pressure seal 30 is arranged in a corresponding receiving bore in the chisel holder 4 and does not project beyond the upper edge of the chisel holder 4 when the chisel is inserted. A gap bridging component 31 is also provided and consists of a head portion 35 and an adjoining tubular portion 32 below. This tubular portion 32 can cooperate with the opening in the annular pressure seal 30 in such a manner that this tubular portion can be inserted in the corresponding opening 36 of the pressure seal 30. The dimensions of the opening 36 and the outer diameter of the tubular portion 32 are so adjusted relative to one another that, upon insertion of the tubular portion 32 in the opening 36 of the pressure seal 30, a bearing pressure is exerted on the pressure seal 30 at the wall of the recess in the chisel holder 4.

Figure 2:
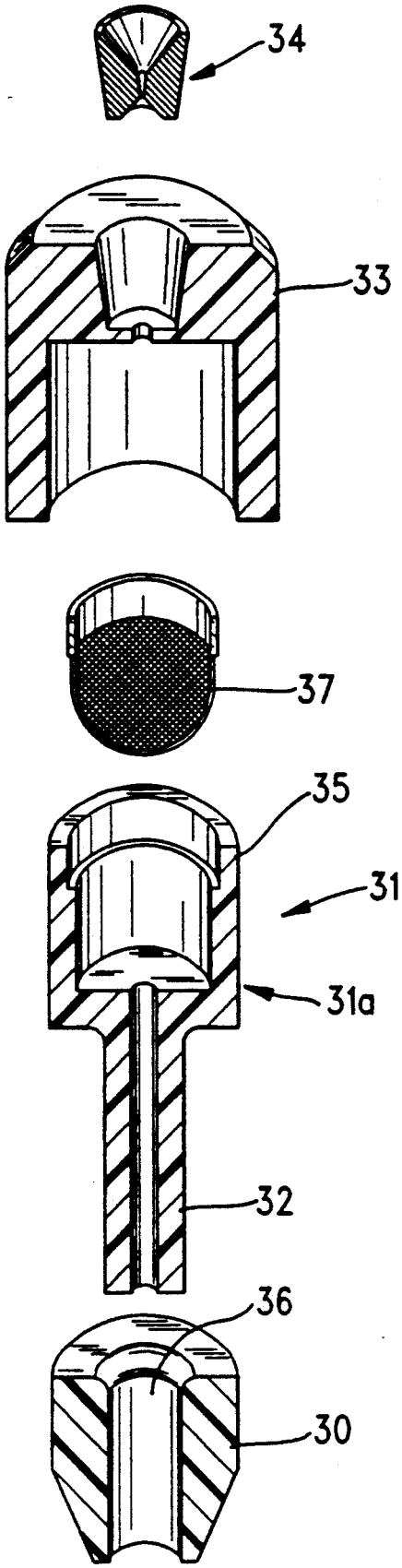

In the exemplary embodiment illustrated in FIG. 2, the gap bridging component 31 is made of two parts and consists of a lower part 31*a* and an upper part 33 constituting a head portion which can fit over the head portion 35 of the part 31*a*. This design makes it possible to insert a sieve 37 in the gap bridging component 31.

A nozzle 34, having a design which is known per se, is exchangeably inserted in the head part 33.

As can be seen from the illustration in FIG. 1, a bore or a recess 38 is provided in the support flange of the chisel head 2 and the upper part 33 of the gap bridging component 31 can engage in the bore or recess 38. The outer diameter of the upper part 33 is here selected such that the upper part 33 always overlaps the pressure seal 30 to the outside. Thus, when the chisel head 2 is changed, the pressure seal 30 is absolutely protected from the surroundings.

The size of the recess 38 is selected so that the upper part 33 engages in this recess 38 with play. Consequently, it is possible to easily remove the chisel from the chisel holder 4 without thereby affecting the tight seating of the pressure seal 30 against the wall of the corresponding receiving bore.

By virtue of this arrangement, it is possible to simultaneously set back the actual nozzle 34 from the upper edge of the foot of the chisel head 2 so that damage to the nozzle 34 cannot occur so rapidly here.

In summary, it can thus be stated that, as a result of this arrangement, the actual nozzle 34 is mounted out of harm's way.

During a chisel change, the actual sealing element, namely, the pressure seal 30, is not exposed so that no soiling of the actual sealing surfaces can occur here. Accordingly, even when operating at high pressures of, for example, 200 bars, no leaks can arise here.

The arrangement of the tubular portion 32 within the pressure seal 30 acts along the same lines. Thus, this tubular portion 32, which is made of relatively rigid plastic, is in a position to absorb the pressure of 200 bars without being affected. Finally, it is possible to install a filter or sieve 37 without difficulty.

I claim:

1. An implement for a material-removing apparatus comprising a material-removing element having a material-contacting edge and a first recess; a holder for said material-removing element having a second recess which registers with said first recess when said material-removing element is mounted on said holder, said second recess being connectible with a source of fluid; a hollow sealing element receivable in said second recess; and means for directing fluid from said second recess towards said edge, said directing means including a tubular element designed to bridge said recesses and having a narrower first portion receivable in said sealing element and a wider second portion receivable in said first recess, and said directing means further including a nozzle receivable in said first recess and mountable on said second portion.

2. The apparatus of claim 1, wherein said material-removing element comprises a chisel.

3. The apparatus of claim 1, wherein said sealing element is sleeve-like.

4. The apparatus of claim 1, wherein said material-removing element includes a flange which is adjacent said holder when said material-removing element is mounted on said holder, said first recess being located in said flange.

5. The apparatus of claim 1, wherein said directing means further includes a carrier for said nozzle, said carrier being receivable in said first recess and being designed to embrace at least part of said second portion.

6. The apparatus of claim 5, wherein said carrier is receivable in said first recess with clearance.

7. The apparatus of claim 5, wherein said directing means further includes a sieve which is receivable between said second portion and said carrier.

8. The apparatus of claim 1, wherein said nozzle is interchangeable.

9. The apparatus of claim 1, wherein said material-removing element has an external peripheral surface and said directing means is spaced from said surface.

* * * * *